US009004032B2

(12) United States Patent
Itoafa

(10) Patent No.: US 9,004,032 B2
(45) Date of Patent: Apr. 14, 2015

(54) SEAL FOR SWITCH VALVES

(75) Inventor: Calin Petru Itoafa, Hoechstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/113,692

(22) PCT Filed: Feb. 3, 2012

(86) PCT No.: PCT/EP2012/051867

§ 371 (c)(1),
(2), (4) Date: Oct. 24, 2013

(87) PCT Pub. No.: WO2012/150048

PCT Pub. Date: Nov. 8, 2012

(65) Prior Publication Data

US 2014/0041609 A1 Feb. 13, 2014

(30) Foreign Application Priority Data

May 2, 2011 (DE) ..... 10 2011 075 043

(51) Int. Cl.

| | |
|---|---|
| ***F01L 1/14*** | (2006.01) |
| ***F01L 1/46*** | (2006.01) |
| ***F01L 9/02*** | (2006.01) |
| ***F01L 13/00*** | (2006.01) |

(52) U.S. Cl.

CPC ... *F01L 1/46* (2013.01); *F01L 9/02* (2013.01); *F01L 9/025* (2013.01); *F01L 13/0015* (2013.01)

(58) Field of Classification Search

CPC ..... F01L 1/46; F01L 13/0015; F01L 9/02; F01L 9/025

USPC ..... 123/90.52, 90.55, 90.43, 90.59

See application file for complete search history.

(56) References Cited

U.S. PATENT DOCUMENTS

| | | | | |
|---|---|---|---|---|
| 2006/0261301 | A1 | 11/2006 | Eiser et al. | |
| 2009/0007207 | A1 | 1/2009 | Kashalkar et al. | |
| 2010/0224148 | A1 | 9/2010 | Kuhl et al. | |
| 2010/0242886 | A1 * | 9/2010 | Katsumata et al. | 123/90.52 |

FOREIGN PATENT DOCUMENTS

| | | |
|---|---|---|
| DE | 10 2005 061 509 | 9/2006 |
| DE | 10 2009 011 983 | 9/2010 |
| WO | WO 2009/007207 | 1/2009 |

* cited by examiner

*Primary Examiner* — Zelalem Eshete

(74) *Attorney, Agent, or Firm* — Davidson, Davidson & Kappel, LLC

(57) ABSTRACT

A switch valve for a hydraulic unit, in particular a quick-acting valve for a hydraulic unit of a hydraulically variable valve gear of a reciprocating internal combustion engine, having a valve body, which is guided in an axially movable manner in a housing part and which is sealed with respect to the housing part by a seal, wherein the seal is designed as a flat seal element, which encloses the valve body in a sealing manner and which is operatively connected to an axial surface of the housing part in a sealing manner.

8 Claims, 2 Drawing Sheets

SEAL FOR SWITCH VALVES

The invention concerns a switch valve for a hydraulic unit, particularly a rapid-action switch valve for a hydraulic unit of a hydraulically variable valve train of a reciprocating internal combustion engine, said valve comprising a valve body which is guided for axial displacement in a housing part and is sealed from the housing part through a seal.

BACKGROUND

A hydraulic unit comprising a switch valve of a generic type is known from DE 10 2009 011 983 A1. In the field of such so-called pressure-compensated switch valves, it is common knowledge to provide a groove in the housing part in which seal a sealing ring that serves to seal the valve body is inserted. Sealing rings of different types and shapes are known form the catalogue of the company of Kölbel Vertriebs GmbH, 93055 Regensburg published in the year 2010.

SUMMARY OF THE INVENTION

Particularly in the case of a hydraulic unit in which the switch valve is activated with a high frequency, the problem exists that sealing rings rigidly inserted into the groove either undergo excessively high friction and deteriorate the movement of the valve body or that, on the other hand, the leak tightness is not durably assured.

It is an object of the invention to provide a switch valve comprising a seal with which the aforesaid drawbacks are avoided and a durable sealing action, even at high frequencies, is assured using a simple and cost-effective means.

The present invention provides a seal configured as a flat sealing element that encloses the valve body in a sealing manner and operatively connected to an axial surface of the housing part and particularly to a front end surface of the housing part, in a sealing manner.

The flat sealing element centers itself on the valve body and thus takes a corresponding radial position on the axial surface of the housing part. Therefore, in other words, the flat sealing element is radially float mounted on the axial front end surface of the housing part so that an effective and low-wear sealing is assured between the axial surface and the housing part.

The flat sealing element is made preferably out of an elastic sealing material, particularly out of an elastomeric material, a fluoroplastic or the like. Because these material groups include a number of individual elastomers or individual fluoroplastics, it is easily possible to select the proper material in view of the temperature of operation, the kind of oil and the coefficient of friction.

The flat sealing element advantageously comprises a metallic, disc-shaped base body comprising an at least partial cladding made out of an elastic material. This elastic material in turn can also be selected out of the group of elastomeric materials or fluoroplastics or the like, which elastic material is arranged and fixed at least partially on the base body.

The cladding is advantageously applied to the inner region of the disc-shaped base body facing the valve body and at least partially on the side of the disc-shaped base body facing the axial surface.

Such a flat sealing element is preferably suitable for a switch valve in which the valve body comprises a sealing surface that is situated outside of the housing part and forms a valve seat, preferably a conical valve seat, together with a counter surface situated on a seating ring, the flat sealing element being arranged on the front end surface of the housing part. The flat sealing element is preferably loaded by a spring that is supported on the seating ring and presses the flat sealing element against the front end surface, the spring being supported on that side of the flat sealing element that is turned away from the cladding comprising the elastic material. The flat seal is retained in a sealing manner on the front end surface and pressed by the spring only to the extent that the leak tightness is assured despite radial resilience.

Because the function of the switch valve is defined by the opening and closing and the leak tightness on the valve seat, for avoiding double fitting, the sliding seating of the valve body in the housing part is chosen to be that large that leak tightness on the valve seat is always assured. The proposed flat sealing element is capable of adjusting itself appropriately in radial direction. Moreover, the sealing surface on the front end surface of the flat sealing element as viewed in axial direction of the valve body is relatively small so that even a tilting of the valve body in the housing part does not have a negative effect on the sealing function.

BRIEF DESCRIPTION OF THE DRAWINGS

For a further elucidation of the invention, reference is made to the drawings in which one example of embodiment of the invention is shown in simplified illustrations.

DETAILED DESCRIPTION

Figure 1:
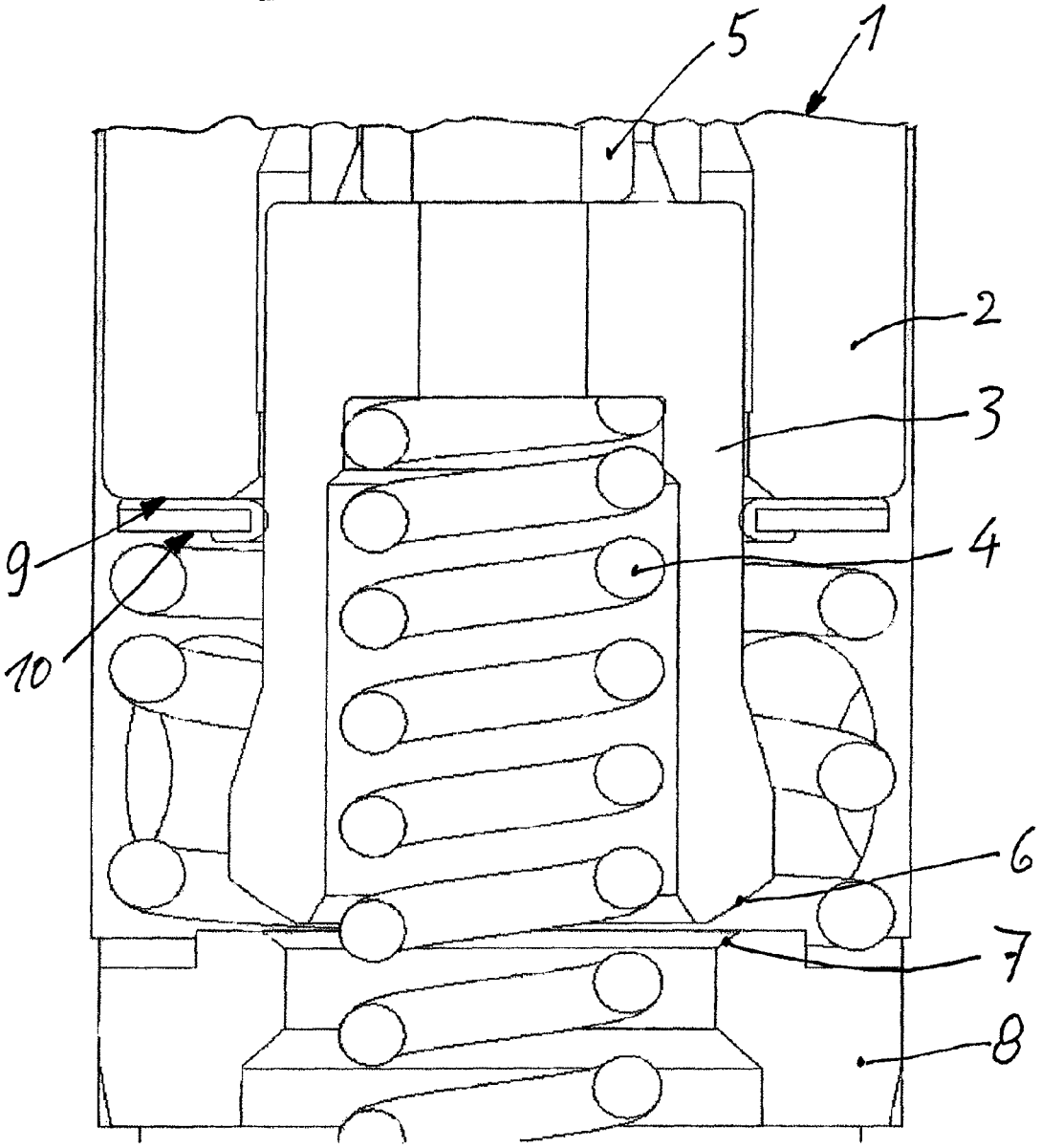
FIG. 1 shows a longitudinal section through a switch valve taken through the flat sealing element.
Figure 2:
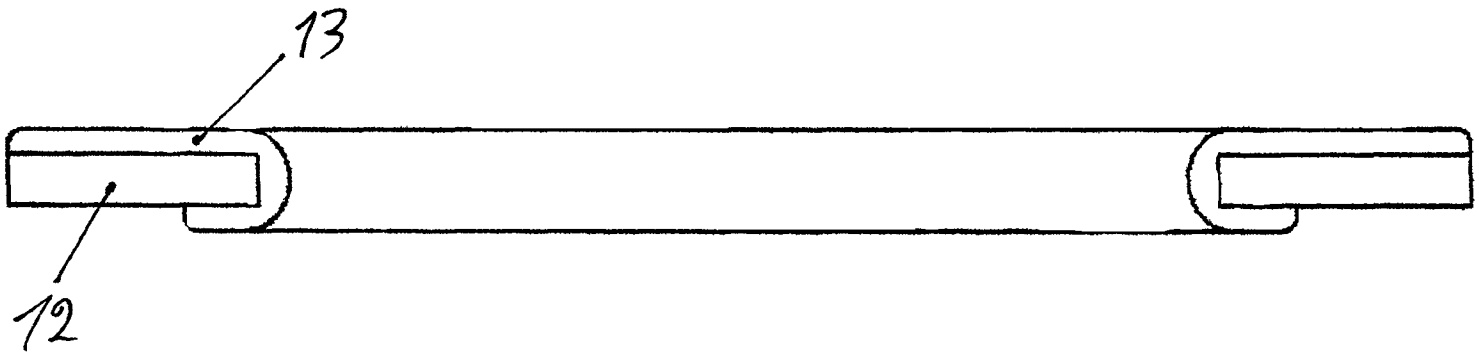
FIG. 2 shows a section through the flat sealing element on a considerably enlarged scale.

In FIGS. 1 and 2, a rapid-action switch valve, as far as specifically shown, is generally identified at 1. The rapid-action switch valve comprises a housing part 2 in which a valve body 3 is guided for axial displacement, which valve body 3 is supported at one end on a compression spring 4, while being controlled at the other end by a control element 5. The valve body 3 has a substantially pot-shaped configuration and comprises on its ring-shaped end, a sealing surface 6 that is associated to a counter surface 7. This counter surface 7 is a component part of a seating ring 8 that is likewise fixed on the rapid-action switch valve 1. The housing part 2 comprises an axial front end surface 9 facing the seating ring 8. A flat sealing element generally identified at 10 bears against the axial front end surface 9. The flat sealing element is pressed against the front end surface 9 by a spring 11 that is supported on the seating ring 8. The spring force is chosen so that, on the one hand, the leak tightness between the flat sealing element 10 and the front end surface 9 is assured and, on the other hand, this spring force is not so large as to prevent the flat sealing element 10 from adjusting itself in radial direction on the front end surface 9. The flat sealing element 10 comprises a base body 12 that has a disc-shaped configuration and is made of a metal. The base body 12 is enclosed on its inner region and on one side surface by an elastic material 13 that is preferably chosen out of the group of elastomeric materials or fluoroplastics and is sprayed or vulcanized onto the base body 12.

Because the flat sealing element 10 comprises a radius, that is to say, has a rounded configuration on its inner side facing the valve body 3, an optimal sealing effect, which is also insensitive to tilting, is obtained on the outer wall of the valve body 3.

By reason of the conical sealing surface 6 and the correspondingly conical counter surface 7, the flat sealing element 10 can adjust itself radially on the front end surface 9 so that an optimal is realized.

LIST OF REFERENCE NUMERALS

1 Rapid-action switch valve
2 Housing part
3 Valve body
4 Compression spring
5 Control element
6 Sealing surface
7 Counter surface
8 Seating ring
9 Axial surface/front end surface
10 Flat sealing element
11 Spring
12 Base body
13 Elastic material

The invention claimed is:

1. A switch valve for a hydraulic unit, the switch valve comprising:

a housing part;

a seal; and a valve body guided for axial displacement in the housing part and sealed from the housing part through the seal, the seal being configured as a flat sealing element enclosing the valve body in a sealing manner and operatively connected to an axial surface of the housing part in a sealing manner, wherein the flat sealing element is arranged on a front end surface of the housing part, and wherein the flat sealing element includes a metallic, disc-shaped base body including an at least partial cladding out of the elastic material.

2. The switch valve as recited in claim 1 wherein the flat sealing element is made out of an elastic material.

3. The switch valve as recited in claim 2 wherein the elastic material is an elastomeric material or a fluoroplastic.

4. The switch valve as recited in claim 1 wherein the cladding is applied to an inner region of the disc-shaped base body facing the valve body and at least partially to a side of the disc-shaped base body facing the axial surface.

5. The switch valve as recited in claim 1 further comprising a seating ring, the valve body including a sealing surface arranged outside of the housing part and forming a valve seat together with a counter surface arranged on the seating ring.

6. The switch valve as recited in claim 5 further comprising a spring arranged between the flat sealing element and the seating ring, the spring loading the flat sealing element in a direction of the front end surface.

7. A rapid-action switch valve for a hydraulic unit of a hydraulically variable valve train of a reciprocating internal combustion engine, comprising the switch valve as recited in claim 1.

8. A switch valve for a hydraulic unit, the switch valve comprising:

a housing part;

a seal;

a valve body guided for axial displacement in the housing part and sealed from the housing part through the seal, the seal being configured as a flat sealing element enclosing the valve body in a sealing manner and operatively connected to an axial surface of the housing part in a sealing manner; and a seating ring, the valve body including a sealing surface arranged outside of the housing part and forming a valve seat together with a counter surface arranged on the seating ring; and a spring arranged between the flat sealing element and the seating ring, the spring loading the flat sealing element in a direction of the front end surface.

* * * * *